United States Patent [19]

Napier

[11] 4,115,969

[45] Sep. 26, 1978

[54] BUILDING PANEL AND WALL

[76] Inventor: Donald Stewart Napier, 744 Canterbury Rd., Surrey Hills, Victoria, Australia, 3127

[21] Appl. No.: 813,355

[22] Filed: Jul. 6, 1977

[51] Int. Cl.[2] ..... E04B 1/10

[52] U.S. Cl. ..... 52/233; 52/284

[58] Field of Search ..... 52/233, 284, 384–386

[56] References Cited

U.S. PATENT DOCUMENTS

| | | | |
|---|---|---|---|
| 678,052 | 7/1901 | Slye | 52/233 |
| 1,841,127 | 1/1932 | Ilson | 52/233 |
| 2,309,462 | 1/1943 | Williams | 52/233 |
| 2,550,883 | 5/1951 | Vincent | 52/233 |
| 3,377,758 | 4/1968 | Witschnig | 52/233 |
| 3,672,107 | 6/1972 | Santry et al. | 52/284 |
| 4,012,876 | 3/1977 | Grubbs | 52/233 |

*Primary Examiner*—J. Karl Bell

*Attorney, Agent, or Firm*—Donald D. Jeffery

[57] ABSTRACT

Walls are constructed using roof support posts for load bearing, and panels therebetween. The panels provide both the inner and outer surfaces of the walls, and form with adjacent panels, recesses to accommodate the roof support posts.

6 Claims, 9 Drawing Figures

BUILDING PANEL AND WALL

The present invention relates to the construction of walls for houses and other buildings and to panels, for use in such walls, particularly panels for use in the construction of log and/or plank cabins, houses or the like, and to the manner in which the panels are affixed to form said cabins, houses and the like.

Log and/or plank cabins, with their walls of logs and/or planks laid one upon the other look attractive and blend well with the bushland. However, being made of individual logs and/or planks, their construction is time consuming and tedious as straight logs have to be carefully selected and any gaps between them plugged to make the cabin weatherproof.

The object of the present invention is to provide a panel for use in the construction of log and/or plank cabins, houses or like structures, or for use as partitioning wherein the above mentioned disadvantages are avoided and construction is rapid, yet easy. A further object of the present invention is to provide a novel, simple manner of affixing these panels and other similar panels to form walls.

According to the present invention, there is provided a wall of a cabin, house or the like, said wall being constructed by erecting a desired number of roof support posts, locating between adjacent support posts wall panels, the outer vertical edges of which abut to enclose the support posts within a recess formed by adjacent panels, the inner vertical edges of the panels being covered by coverplates which enclose the support posts within the recess, the outer surface of the panel forming the outer surface of the wall, and the inner surface of the panel being the inner surface of the wall.

The panel may comprise a plurality of logs and/or planks arranged side by side so as to present a panel having at least one surface planar, the logs being sawn in half along their longitudinal axis so that the other surface is formed of half round logs, the edges of adjacent logs and/or planks having interlocking tongues and grooves to form a weatherproof joint therebetween, a reinforcing rod running through the panel normal to the longitudinal axis of the logs and/or planks, both ends of the rod being bolted to the corresponding edge log and/or plank.

The panel so formed is preferably provided on its inner surface with a rectangular framework, the upper and lower horizontal members thereof forming the architrave and skirting board for the room within, while the vertical side members form with similar vertical side members of adjacent panels recesses wherein are located support posts for the roof structure of the cabin, house or the like.

But in order that the invention will be more clearly understood, reference will now be made to the accompanying drawings wherein.

Figure 1:
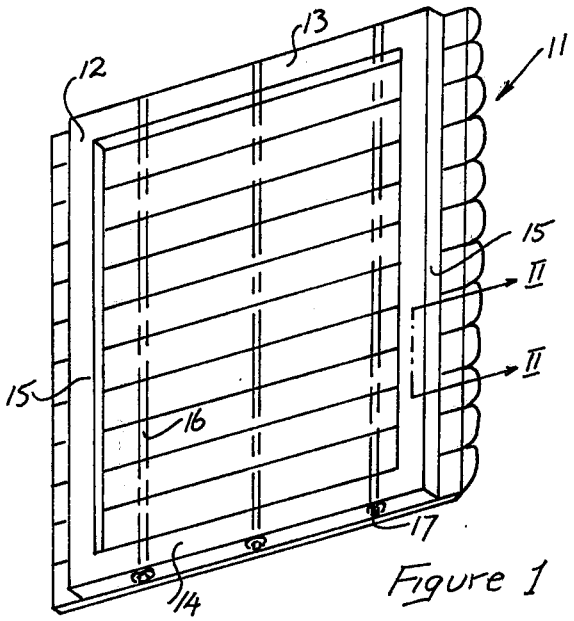
FIG. 1 shows the inner face of a panel according to one emboidment of the present invention.

The panel 11 shown in FIG. 1 has its inner surface planar, preferably polished, and may be used to form the final inner wall of a room, cabin, house or the like. The outer surface, shown only in section, is formed of half logs interlocked together. A framework 12 is attached to the inner surface, the upper and lower horizontal frame members 13 and 14 acting as the architrave and skirting board respectively of the room within, while the vertical members 15 are used to enclose the metal support posts which form the structural framework of the cabin or house and support the roof thereof.

Reinforcing rods 16 (shown in dotted lines) are provided in each panel, the rods serving to maintain the panel rigid against any tendency to slip sideways and having threaded ends so that nuts 17 thereon may be tightened to take up any slack caused by shrinkage of the wood in the logs and/or planks forming the panel.

Figure 2:
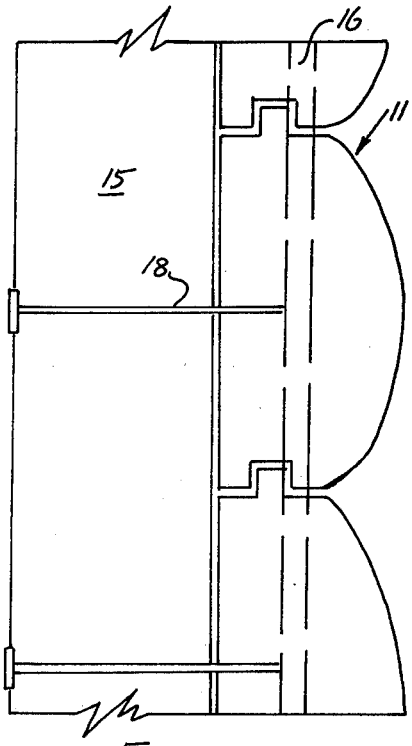
FIG. 2 shows an enlarged view on Section II — II of FIG. 1.
Figure 3:
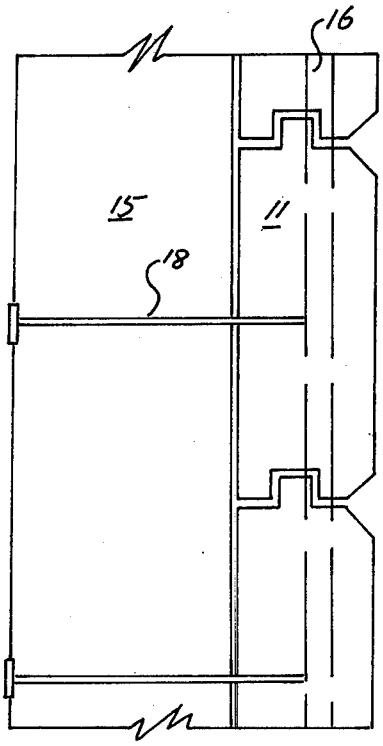
FIG. 3 is a view similar to FIG. 2 of a modified panel.
Figure 8:
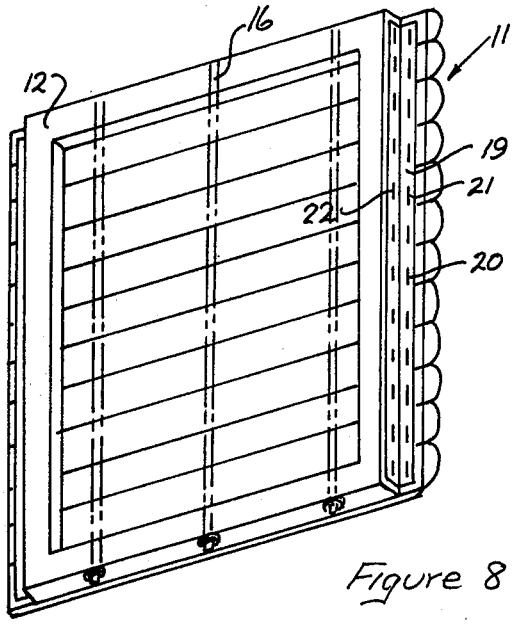
FIG. 8 is a view similar to FIG. 1 showing a preferred method of securing the panel and framework.

FIGS. 2 and 3 show the manner in which the logs (FIG. 2) and planks (FIG. 3) are interlocked together and attached to the framework 12 by spikes 18. Alternatively, an angle bar 19 (FIG. 8) may be used to attach the logs or planks to the framework 12, slots 20 being provided in the bar 19 so that fasteners 21 may slide therealong as the wood in the logs or planks shrinks, fasteners 22 in holes in the other arm of the angle bar 19 being rigidly fixed to the framework 12.

FIGS. 4 to 7 show the manner in which adjacent panels are joined to each other, adjacent vertical members of adjacent frameworks forming a recess 23 wherein steel support posts 24 are housed. A continuous strip of flashing 25 within the recess, shielding the post from the actual joint ensures that the joint remains weatherproof, coverplates 26 fastening the edges of the strip to the framework 12. If desired, service pipes and wires may be located in the recess 23.

Figure 4:
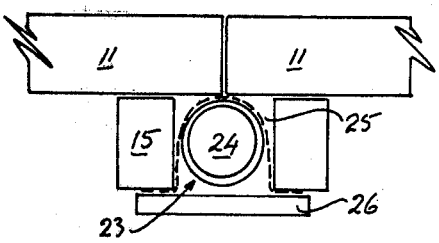
FIG. 4 shows two panels joined together in one plane.

As shown in FIG. 4, when it is desired to join two panels in the same plane, their ends are butted together, the vertical frame members 15 enclosing post 24 and flashing 25. Cover plate 26 hides the joint from the interior of the room, and is preferably polished or otherwise treated to match the polish or other surface finish on the inner face of the panel.

Figure 5:
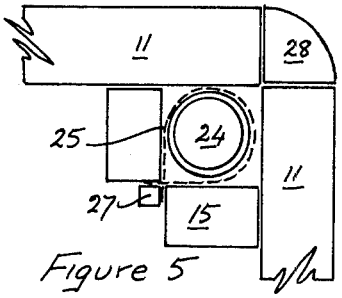
FIG. 5 shows two panels joined together perpendicular to each other.
Figure 6:
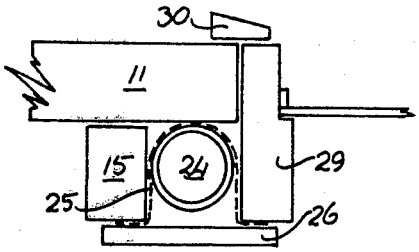
FIG. 6 shows a panel joined to a window panel.

When two panels are joined at right angles to each other, as shown in FIG. 5, the vertical frame members are set slightly further from the panel sides so that they can accommodate the support post 24 in the square hollow so formed. Flashing 25 around the post 24 is held in position by the square bead 27, while a quarter log 28 may be used to enclose the external gap between the two panels.

Figure 7:
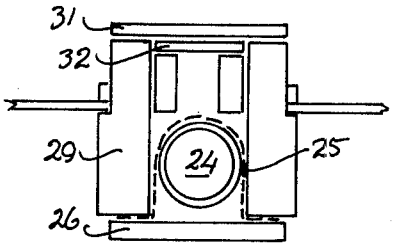
FIG. 7 shows two window panels joined together.

The frames 29 of the windows are designed to project the same distance into each room as does the framework 12 so that a coverplate, identical to coverplate 26 may be used at junctions between the panels and windows (FIG. 6) and between two windows (FIG. 7). Winmoulds 30 cover the external gap between the panel and window frame, while coverplate 31 and infill panel 32 are used to bridge and cover the external gap between two windows.

Figure 9:
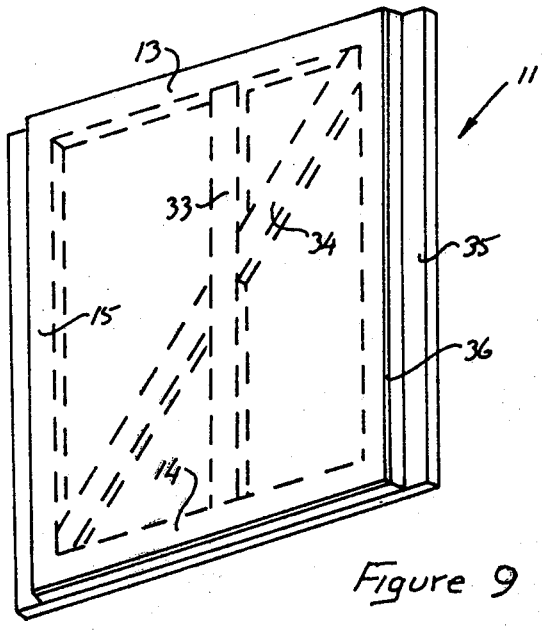
FIG. 9 is a view similar to FIG. 1 showing a modified panel.

The panel shown in FIG. 9 has the framework 12 braced by vertical strut 33 and cross member 34, outer cladding 35, such as redwood ply, and internal cladding 36 being attached to the framework, the gap between the framework and the cladding preferably being filled with insulation to compensate for the thinner cladding. Internal cladding 36 may have a timber, plaster, laminated plastic or other desired surface finish.

When constructing a cabin or the like, the flooring, either concrete slab or a timber floor with preferably concrete footings, is first placed in position, then a framework of steel posts erected and finally the roof. The roof may be made of any conventional finish or it may be made of similar panels. Once the roof and flooring are in position, the panels which are of the desired wall height are located between adjacent posts such that they butt end to end behind each post. Windows and door panels are located where desired, these panels also ocupying the space between two adjacent posts. The side vertical members together with the butted side edges of adjacent panels form a recess enclosing the steel post, a flat strip of timber forming a coverplate to the recess, so hiding the steel post. If desired, electrical wiring and/or water and/or gas pipes may be located within the recesses for ease of installation thereof. It will be understood although not illustrated that the tops and bottoms of the panels can be secured to the floor and roof to stabilize the mounting thereof.

When logs are used for the panel of the present invention they are first sawn longitudinally of their axes and then at least one tongue and one groove or similar interlocking structure, cut in the opposite edges, the cutting also acting to ensure that the opposite edges are straight so that they interlock with complementary edges of adjacent half logs without gaps therebetween. Further due to the thickness of the logs at the join (point of minimum thickness), the panel so formed has excellent insulation properties, there being no necessity to provide further walls between the inside of the cabin and its exterior. Thus the inner wall is the planar surface of the panel. Being timber, it may be polished with or without prior staining, to provide an attractive wood grain finish to the inner wall.

The panel is preferably provided in 1.7m modules such that any number of cabin floor plans may be readily designed. Other sized modules may be used, dependent on the spacing of the support posts and window panels used.

As the panels provide a complete wall panel, it will be apparent that they are ideally suited for use by the 'do-it-yourself' home builder who may either construct the cabin completely, or build onto an erected framework.

Thus it will be seen that the present invention provides a building panel which greatly simplifies the construction of cabins, ranch style houses (using planks), and the like in that it porvides for ease of construction, secure weatherproofing and insulation with an attractive surfaced inner wall.

Although when used to form a conventional log cabin or ranch house, the panels will have the logs and/or planks arranged with their longitudinal axes horizontal, the panels may also be used with the longitudinal axes of the logs and/or planks vertical, especially when using them for cubby houses, tree houses and as the walls of make-believe forts.

I claim:

1. A wall of a cabin, house or like structure, comprising:

a. a plurality of spaced roof support posts extending between the floor and roof of the structure;

b. wall panels extending between said posts and having vertical side edges which abut adjacent to a respective post, said panels being formed adjacent their vertical side edges with frame members which, with the ends of said panels, serve to form a recess around said post;

c. means extending around the outer surface of said post for shielding and thus weatherproofing the abutment joint between adjacent panels, and d. coverplates extending between and secured to said frame members thereby fully enclosing said support post and hiding the joint from the interior of the room, the ends of said shielding means being secured between said coverplates and said frame members.

2. The wall of claim 1 wherein said frame members form part of a rectangular framework on the inner surface of each panel, the upper and lower horizontal members thereof forming the architrave and skirting board for the room within.

3. The wall of claim 1 wherein said panel comprises a plurality of logs and/or planks arranged side by side so as to present a panel having at least one planar surface, the logs being sawn in half along their longitudinal axes so that the other surface is formed of half round logs the top and bottom edges of adjacent logs and/or planks having interlocking tongues and grooves to form a weatherproof joint therebetween, at least one reinforcing rod running through the panel normal to the longitudinal axes of the logs and/or planks, and means for securing said rod to said logs and/or planks.

4. The wall of claim 2 wherein the logs and/or planks are attached to the framework by an angle bar, slots being provided in both legs of the bar so that fasteners extending into the logs and/or planks may slide along said slots as the wood in the logs and/or planks shrinks, the fasteners extending through the other leg of the angle bar being rigidly fixed to the framework.

5. The wall of claim 1 wherein each of said panels includes a braced rectangular framework having inner and outer wall cladding thereon, the space between the inner and outer cladding being insulated, the outer cladding extending beyond vertical side members of the framework which comprise said frame members so that the vertical side members form with similar vertical side members of adjacent panels recesses in which are located support posts for the roof structure of the cabin, house or the like.

6. The wall of claim 1 wherein a continuous strip of flashing is located within the recess, shielding the post from the actual joint to ensure that the joint is weatherproof, said coverplates fastening the edges of the strip to said frame members.

* * * * *